US010752046B2

(12) United States Patent
Cala

(10) Patent No.: US 10,752,046 B2
(45) Date of Patent: Aug. 25, 2020

(54) PROTECTIVE BIB FOR CONTAINER

(71) Applicant: Gregory C. Cala, Belmont, CA (US)

(72) Inventor: Gregory C. Cala, Belmont, CA (US)

( * ) Notice: Subject to any disclaimer, the term of this patent is extended or adjusted under 35 U.S.C. 154(b) by 109 days.

(21) Appl. No.: 15/715,112

(22) Filed: Sep. 25, 2017

(65) Prior Publication Data

US 2018/0015778 A1 Jan. 18, 2018

Related U.S. Application Data

(63) Continuation-in-part of application No. 14/738,750, filed on Jun. 12, 2015, now Pat. No. 9,770,938.

(60) Provisional application No. 62/011,943, filed on Jun. 13, 2014.

(51) Int. Cl.

| | |
|---|---|
| ***B44D 3/12*** | (2006.01) |
| ***B65D 25/20*** | (2006.01) |
| *E05B 47/00* | (2006.01) |

(52) U.S. Cl.

CPC ..... *B44D 3/128* (2013.01); *B65D 25/20* (2013.01); *E05B 47/0038* (2013.01); *Y10T 29/49828* (2015.01)

(58) Field of Classification Search

CPC ..... B44D 3/128; B65D 65/10; B65D 65/14
USPC ..... 220/733
See application file for complete search history.

(56) References Cited

U.S. PATENT DOCUMENTS

| | | | | | |
|---|---|---|---|---|---|
| 788,489 | A * | 4/1905 | Moore | A41D 13/04 | 2/51 |
| 1,243,462 | A * | 10/1917 | Troiano | A45D 44/08 | 2/50 |
| 2,185,413 | A * | 1/1940 | Masterson | B65D 25/48 | 220/694 |
| 2,594,858 | A * | 4/1952 | Bowman | B65D 25/48 | 222/570 |
| 3,272,248 | A * | 9/1966 | O'Farrell | A45C 13/06 | 383/43 |
| 3,406,853 | A * | 10/1968 | McLeod | A61J 9/001 | 215/11.3 |
| 6,250,518 | B1 * | 6/2001 | Thirkettle | B44D 3/128 | 222/567 |
| 6,859,938 | B1 * | 3/2005 | Niski | A41B 13/10 | 2/49.1 |
| 2010/0132226 | A1 * | 6/2010 | Dochter | A43B 1/0081 | 36/136 |
| 2010/0251452 | A1 * | 10/2010 | Hermann | A41B 13/10 | 2/49.1 |
| 2017/0096259 | A1 * | 4/2017 | Adams | B65D 25/48 | |

* cited by examiner

*Primary Examiner* — Mollie Impink
(74) *Attorney, Agent, or Firm* — Bill Jacobs; Kraig Anderson

(57) ABSTRACT

Technologies are generally described for protecting an edge of a container opening from material, such as container contents being moved into or out of the container, and for protecting container contents from contamination from the edge of the container opening, e.g., rust or debris at the edge.

11 Claims, 10 Drawing Sheets

PROTECTIVE BIB FOR CONTAINER

CROSS-REFERENCE TO RELATED APPLICATIONS

This application is a continuation-in-part of U.S. patent application Ser. No. 14/738,750, filed Jun. 12, 2015, and claims priority from U.S. Provisional Pat. App. Ser. No. 62/011,943, filed on Jun. 13, 2014, each of which is incorporated by reference herein in its entirety.

BACKGROUND

Unless otherwise indicated herein, the materials described in this section are not prior art to the claims in this application and are not admitted to be prior art by inclusion in this section.

Containers may be employed to store contents such as liquids, powders, or the like. The edge of a container opening may be undesirably contaminated with the contents of the container as they are moved in or out of the container. For example, a paint can may have an edge that becomes undesirably coated with paint. Subsequent application and/or removal of a paint can lid may become challenging. Also, the edge of the container opening may include foreign matter or contaminants. For example, some paint cans may tend to rust with age. One may create a painted surface using a supply of paint, and may store a color-matched sample of the paint for later "touch up" painting of the existing painted surface. However, the can used to store the color-matched sample may rust or become contaminated with debris. The rust or other debris on the paint can edge may fall into the paint, contaminating the paint and potentially leading to a poor quality "touch up" on the existing painted surface. This may be challenging, since it may be expensive, impractical, difficult, or the like to obtain a new paint sample of the correct color in a new, un-rusted can to "touch up" the existing painted surface.

The present disclosure appreciates that using containers may be a challenging endeavor in view of the potential contamination of container edges and container contents.

SUMMARY

The following summary is illustrative only and is not intended to be in any way limiting. In addition to the illustrative aspects, embodiments, and features described above, further aspects, embodiments, and features will become apparent by reference to the drawings and the following detailed description.

The present disclosure generally describes protective bibs, methods for protecting container openings, kits including protective bibs, and containers including protective bibs. In one embodiment, a protective bib for a container opening is provided. The protective bib may include a flexible barrier layer in the form of a sheet. The flexible barrier layer may include first and second portions. The protective bib may include one or more mounts including a first mount. The first mount may be coupled to the first portion of the flexible barrier layer by at least one of: a bond to the flexible barrier layer; at least partial containment within a pocket formed of the first portion of the flexible barrier layer, provided that the flexible barrier layer and the first mount are not configured to be tied or hooked together; and integral formation with the flexible barrier layer. The first mount may be configured to be manually contracted and to expand freely when released to apply an expansive force effective to hold the first portion of the flexible barrier layer against an inside wall of a container. The first mount may be configured to overlap a first edge of the flexible barrier layer and a second edge of the flexible barrier layer to at least temporarily form a continuous conduit portion extending between the first and second portions of the flexible barrier. The second portion of the flexible barrier layer may be configured to extend across an edge of the container opening to an outside wall of the container.

In another embodiment, a method for protecting a container opening is provided. The method may include providing a container, including: an inside wall; an outside wall; and a container opening defined by an edge. The method may include providing a protective bib. The protective bib may include a flexible barrier layer in the form of a sheet. The flexible barrier layer may include first and second portions. The protective bib may include one or more mounts including a first mount. The first mount may be coupled to the first portion of the flexible barrier layer by at least one of: a bond to the flexible barrier layer; at least partial containment within a pocket formed of the first portion of the flexible barrier layer, provided that the flexible barrier layer and the first mount are not configured to be tied or hooked together; and integral formation with the flexible barrier layer. The first mount may be configured to be manually contracted and to expand freely when released to apply an expansive force effective to hold the first portion of the flexible barrier layer against an inside wall of a container. The first mount may be configured to overlap a first edge of the flexible barrier layer and a second edge of the flexible barrier layer to at least temporarily form a continuous conduit portion extending between the first and second portions of the flexible barrier. The second portion of the flexible barrier layer may be configured to extend across an edge of the container opening to an outside wall of the container. The method may include providing the first mount in a contracted position. The method may include inserting the first mount in the contracted position through the container opening. The method may include releasing the first mount to expand from the contracted position to apply an expansive force effective to hold the first portion of the flexible barrier layer against the inside wall of the container. The method may include folding the second portion of the flexible barrier layer across at least a portion of the edge.

In one embodiment, a kit is provided. The kit may include a protective bib. The protective bib may include a flexible barrier layer in the form of a sheet. The flexible barrier layer may include first and second portions. The protective bib may include one or more mounts including a first mount. The first mount may be coupled to the first portion of the flexible barrier layer by at least one of: a bond to the flexible barrier layer; at least partial containment within a pocket formed of the first portion of the flexible barrier layer, provided that the flexible barrier layer and the first mount are not configured to be tied or hooked together; and integral formation with the flexible barrier layer. The first mount may be configured to be manually contracted and to expand freely when released to apply an expansive force effective to hold the first portion of the flexible barrier layer against an inside wall of a container. The first mount may be configured to overlap a first edge of the flexible barrier layer and a second edge of the flexible barrier layer to at least temporarily form a continuous conduit portion extending between the first and second portions of the flexible barrier. The second portion of the flexible barrier layer may be configured to extend across an edge of the container opening to an outside wall of the container. The kit may include instructions for using the protective bib with the container. The instructions may include providing the first mount in a contracted position. The instructions may include inserting the first mount in the contracted position through the container opening. The instructions may include releasing the first mount to expand from the contracted position to apply an expansive force effective to hold the first portion of the flexible barrier layer against the inside wall of the container. The instructions may include folding the second portion of the flexible barrier layer across at least a portion of the edge.

Various embodiments include a protective bib for a container opening of a container. The protective bib may include a flexible barrier layer. The protective bib may include a first mount. The first mount may be configured to be coupled to a first portion of the flexible barrier layer to hold the first portion of the flexible barrier layer at a first side of a container wall. The flexible barrier layer may be configured to extend across a container edge that may define the container opening in the container wall.

Some embodiments include a method for protecting a container opening of a container. The method may include employing a first mount coupled to a first portion of a flexible barrier layer to hold the first portion of the flexible barrier layer at a first side of a container wall. The method may also include extending the flexible barrier layer across a container edge that may define the container opening in the container wall.

Several embodiments include a kit. The kit may include a protective bib for a container opening of a container. The protective bib may include a flexible barrier layer and a first mount. The first mount may be configured to be coupled to a first portion of the flexible barrier layer to hold the first portion of the flexible barrier layer at a first side of a container wall. The flexible barrier layer may be configured to extend across a container edge that may define the container opening in the container wall. The kit may also include instructions directing a user to use the protective bib with the container. The instructions may include coupling the first mount to the first portion of the flexible barrier layer. The instructions may include applying the first mount to hold the first portion of the flexible barrier layer at the first side of the container wall. The instructions may also include extending the flexible barrier layer across the container edge that defines the opening in the container wall.

Various embodiments include a container. The container may include a container wall. The container wall may have an inside that may define a chamber. The container wall may also have an outside. The container may also include a container edge that may define the container opening in the container wall. The container may also include a protective bib. The protective bib may include a flexible barrier layer and a first mount. The first mount may be coupled to a first portion of the flexible barrier layer to hold the first portion of the flexible barrier layer at a first side of the container wall. The flexible barrier layer may be configured to extend across the container edge that may define the opening in the container wall.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments arranged in accordance with the disclosure and are, therefore, not to be considered limiting of its scope, the disclosure will be described with additional specificity and detail through use of the accompanying drawings, in which:

DETAILED DESCRIPTION

Figure 1A:
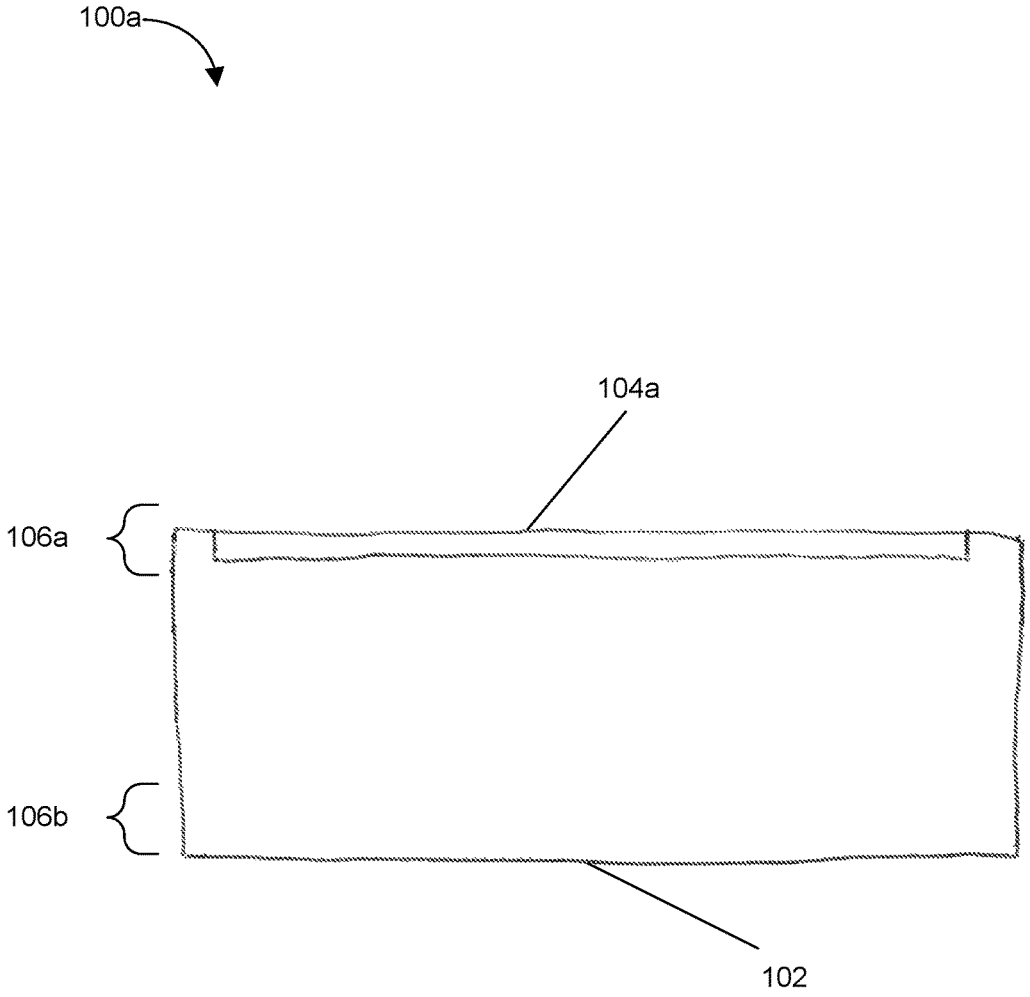
FIG. 1A is a diagram of an embodiment of a protective bib for a container.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to protective bibs, methods, containers, and/or kits related to managing the contamination of container edges or container contents.

Figure 1B:
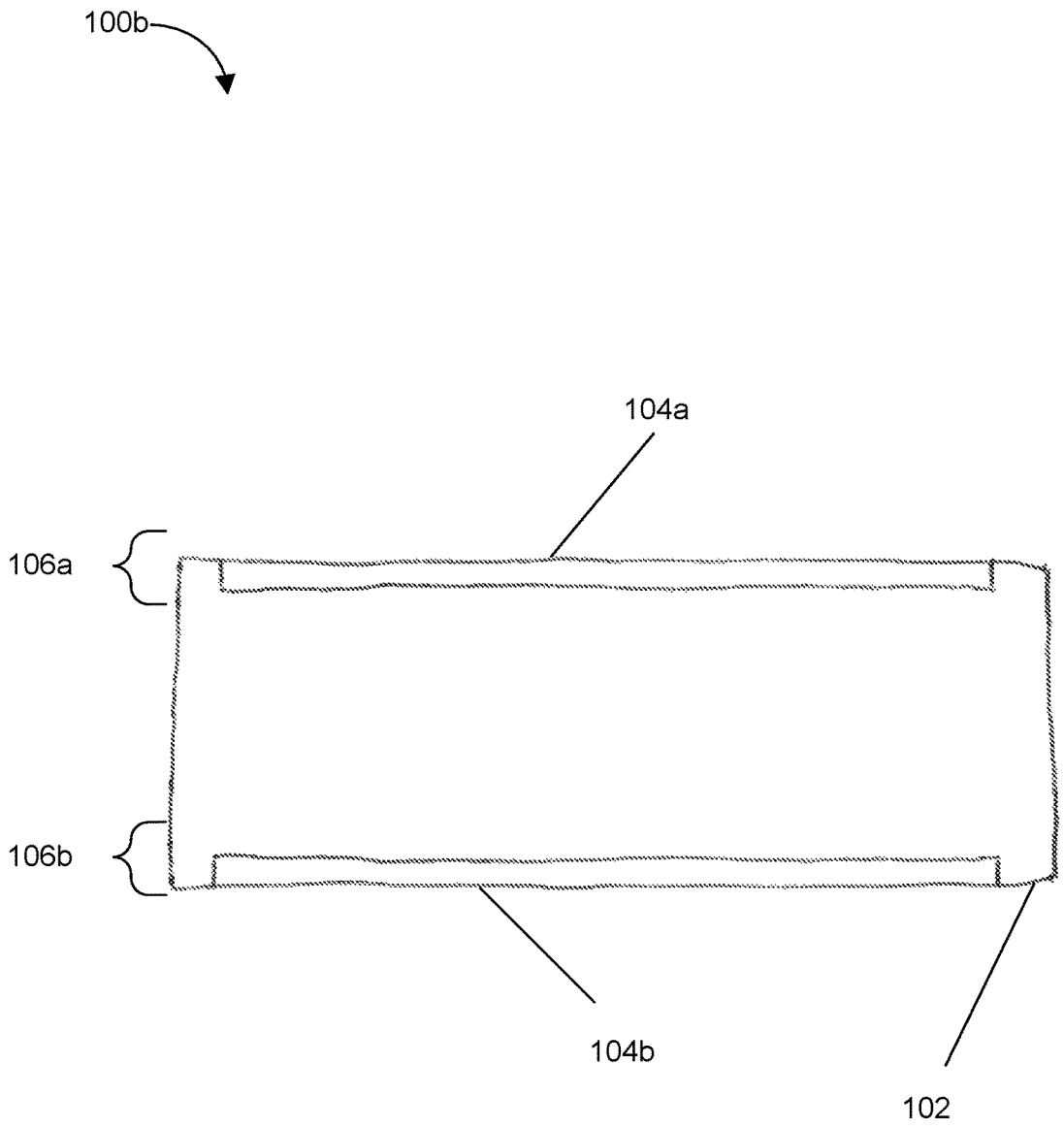
FIG. 1B is a diagram of another embodiment of the protective bib for a container.
Figure 2:
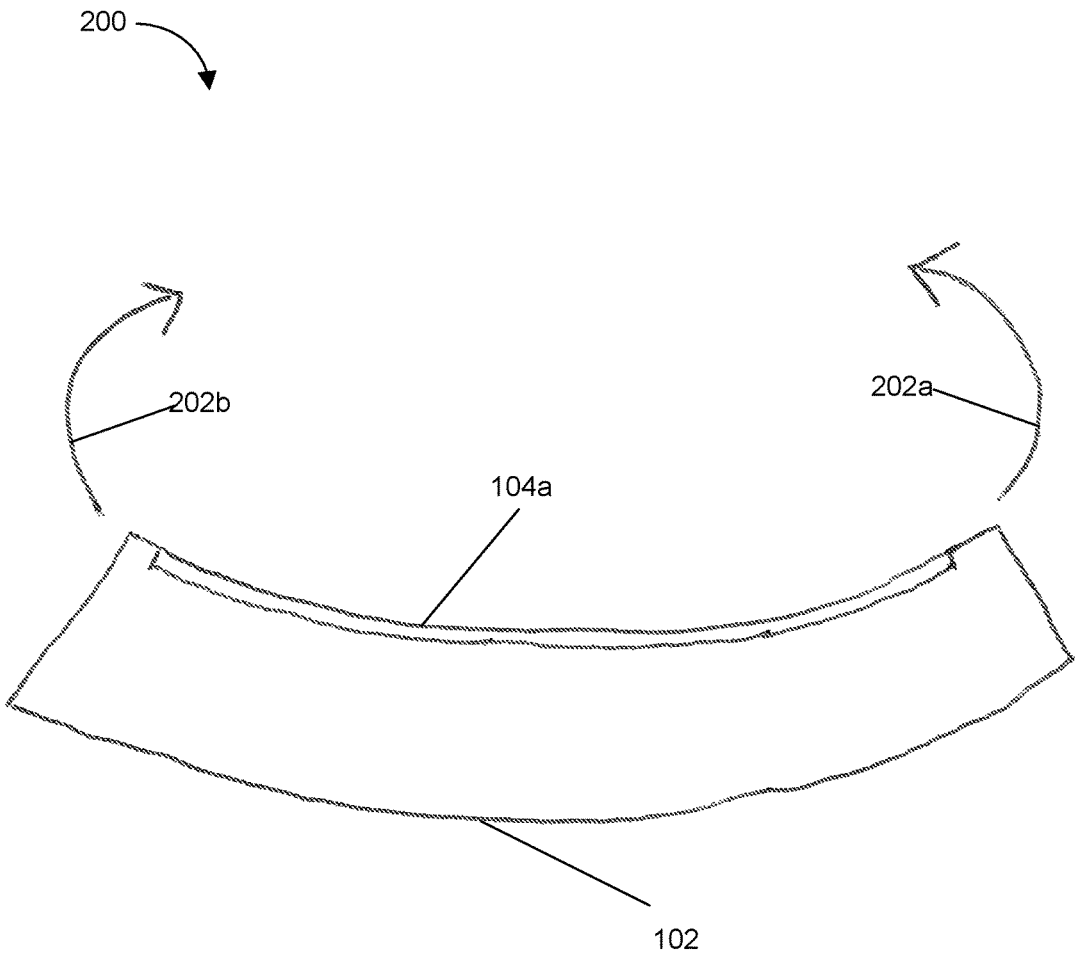
FIG. 2 shows rolling, compressing, or folding of the protective bib for insertion into the container.
Figure 3A:
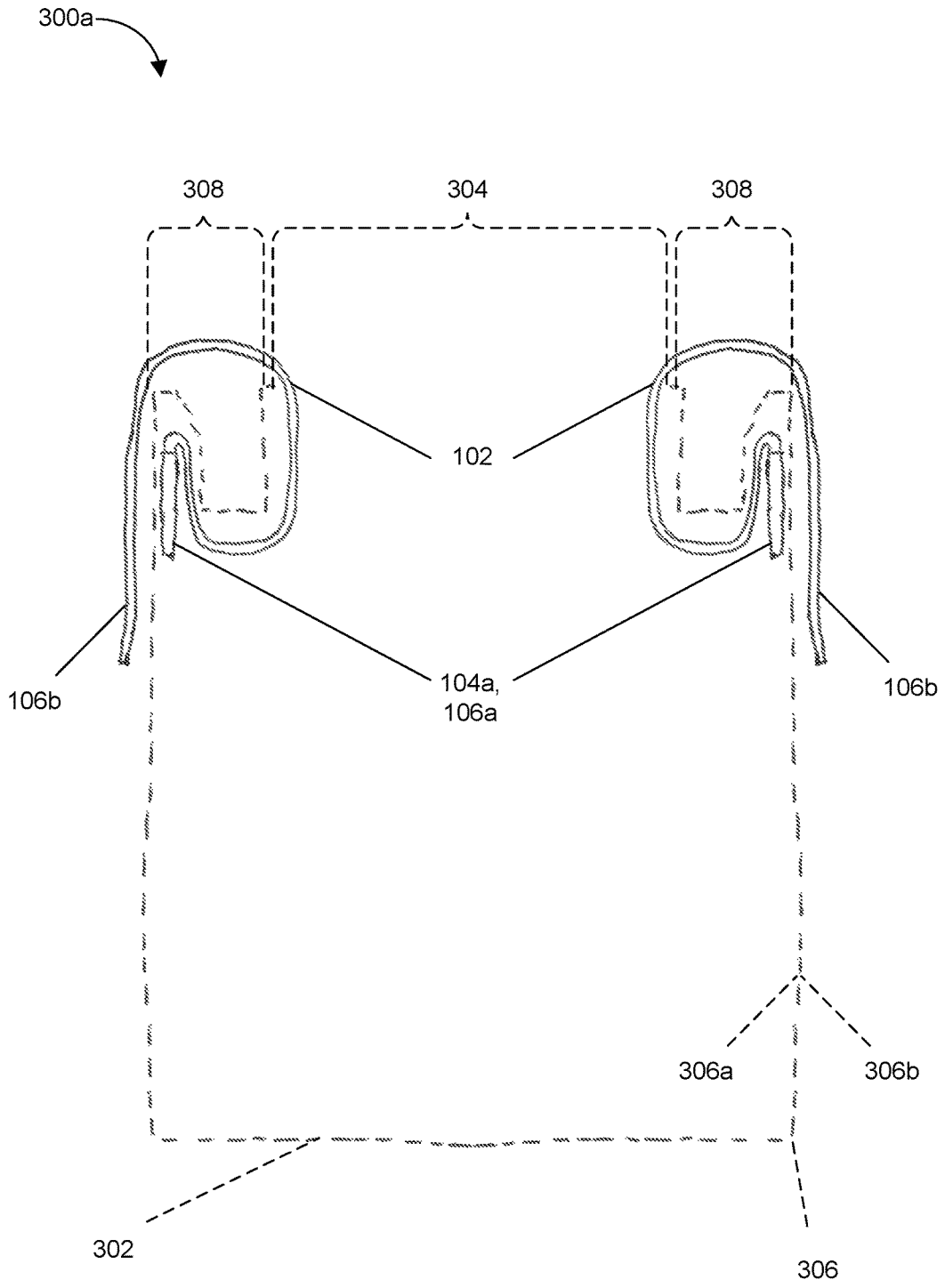
FIG. 3A is a side view of the protective bib installed in a container, depicted as a paint can.
Figure 3B:
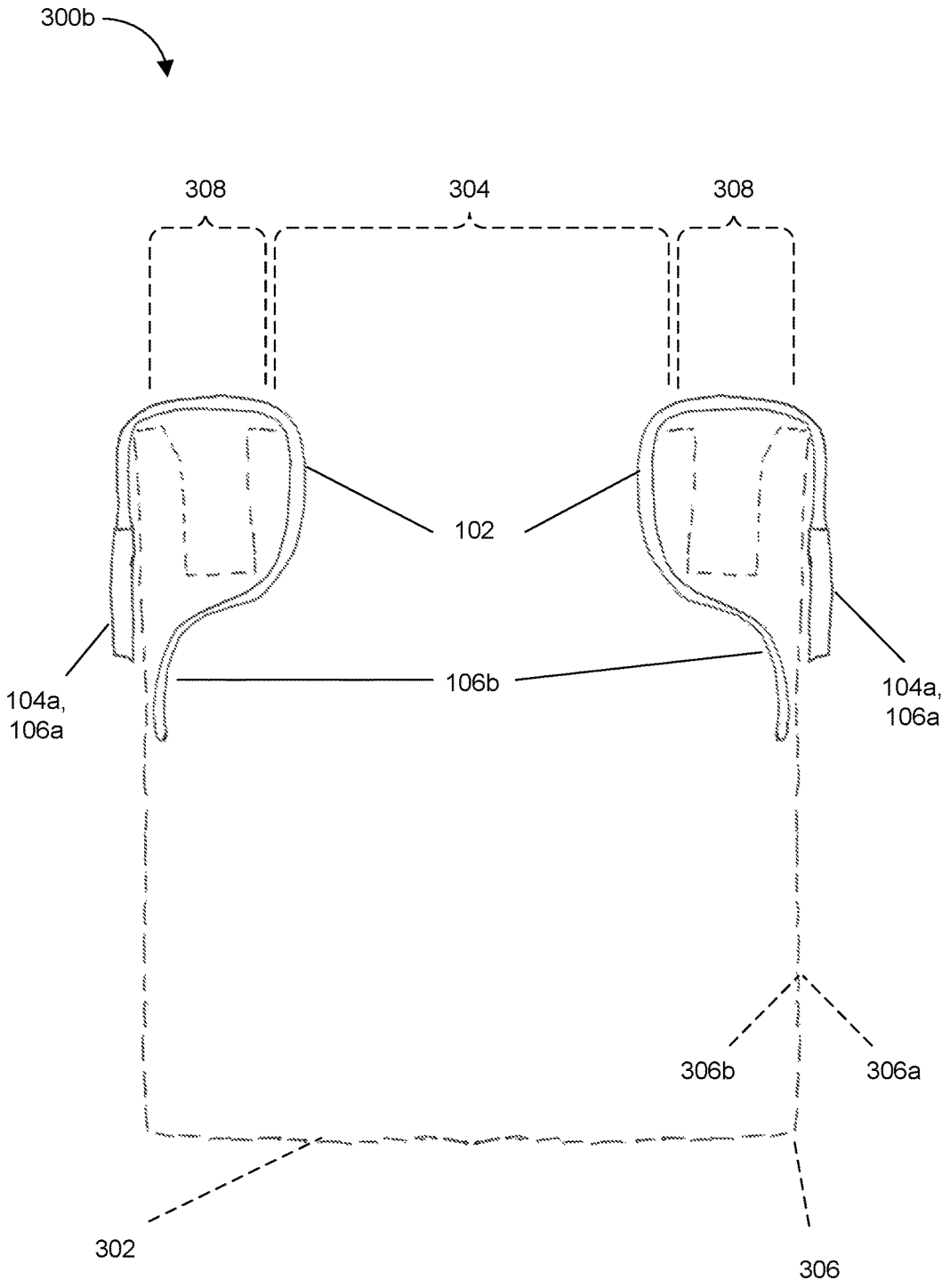
FIG. 3B is a side view of an alternate installation of the protective bib in the container.
Figure 3C:
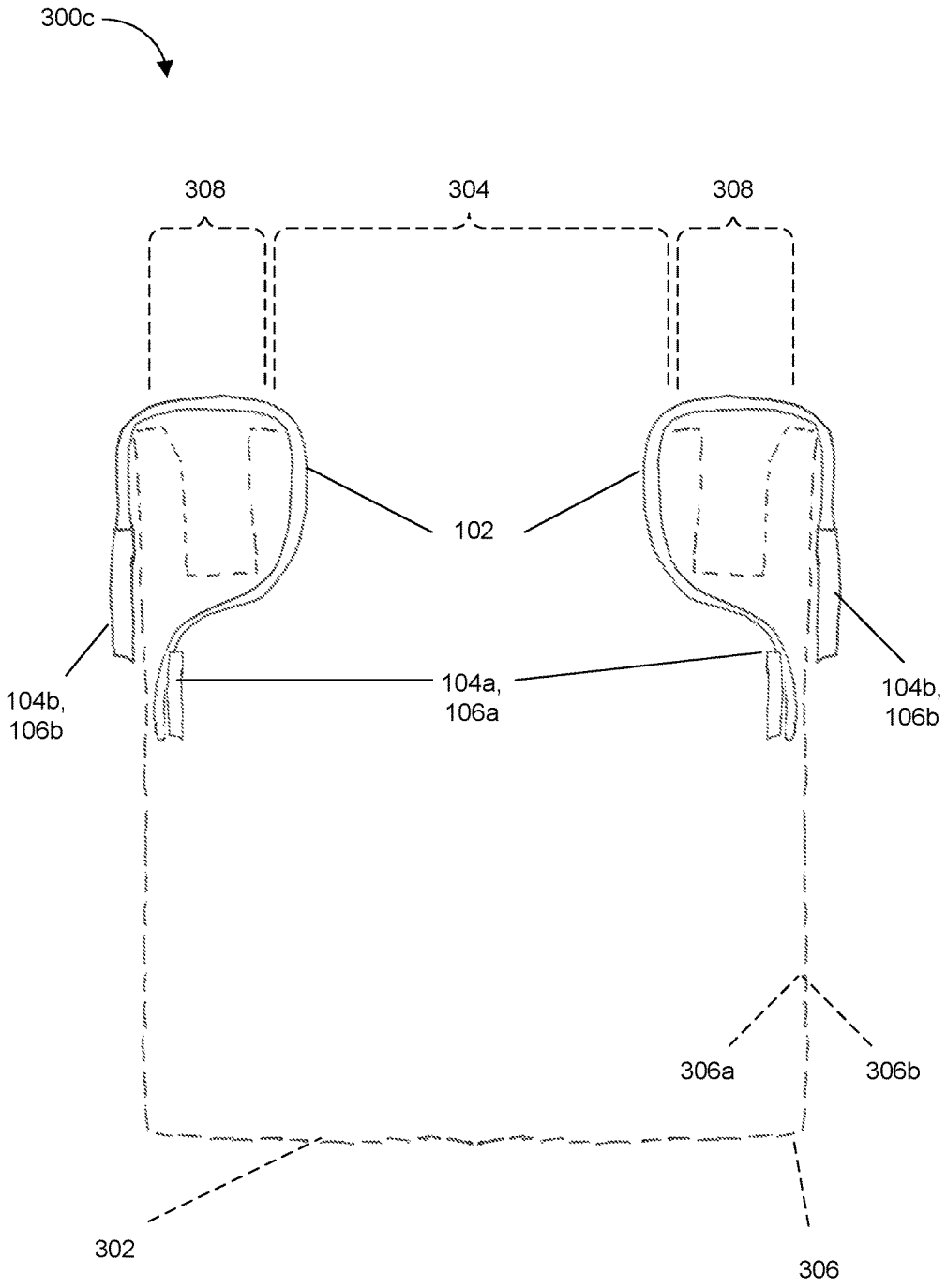
FIG. 3C is a side view of an installation of the protective bib with two mounts in a container.

FIGS. 1A and 1B are diagrams of various embodiments of a protective bib 100*a*. FIG. 2 shows rolling, compressing, or folding of protective bib 100*a* along directions 202*a* and 202*b* for insertion into container 302. FIG. 3A is a side view 300*a* of protective bib 100*a* installed in a container 302, depicted as a paint can. FIG. 3B is a side view 300*b* of an alternate installation of protective bib 100*a* in container 302. FIG. 3C is a side view 300*c* of an installation of protective bib 100*b* in container 302.

Referring to FIGS. 1A, 1B, 3A, 3B, and 3C, various embodiments include protective bib 100*a* for a container opening 304. Protective bib 100*a* may include a flexible barrier layer 102, which may be, for example, in the form of a sheet. Flexible barrier layer 102 may have first and second portions 106*a* and 106*b*, respectively. Protective bib 100*a* may include a first mount 104*a*. First mount 104*a* may be coupled to first portion 106*a* of flexible barrier layer 102 by a bond to the flexible barrier layer, for example, an adhesive bond, a hot melt bond, an ultrasonic welded bond, and the like, First mount 104*a* may be coupled to first portion 106*a* of flexible barrier layer 102 by at least partial containment within a pocket (not shown), provided that flexible barrier layer 102 and first mount 104*a* are not configured to be tied or hooked together. Such a pocket may be formed of first portion 106*a* of flexible barrier layer 102, e.g., flexible barrier layer 102 may be folded and bonded to itself at first portion 106*a* to form such a pocket. First mount 104*a* may be coupled to first portion 106*a* of flexible barrier layer 102 by integral formation (not shown) with the flexible barrier layer 102, e.g., first mount 104*a* may be formed of a thicker portion of the same material, e.g., a polymer, as flexible barrier layer 102. Flexible barrier layer 102 may be configured to extend across a container edge 308 that may define container opening 304 in container wall 306.

Figure 4A:
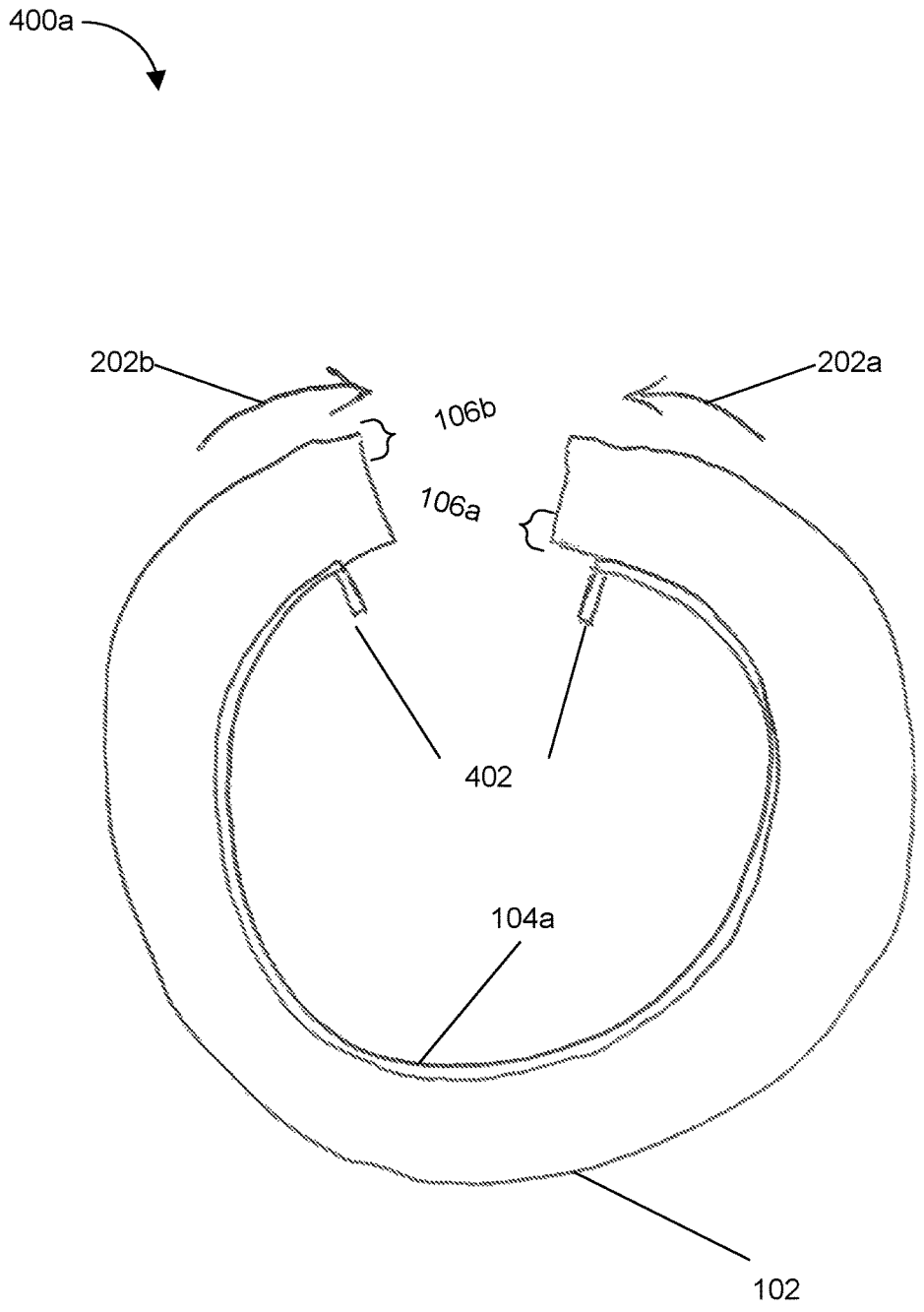
FIG. 4A shows a top view of compression, folding, or rolling of the protective bib as in FIG. 2.
Figure 4B:
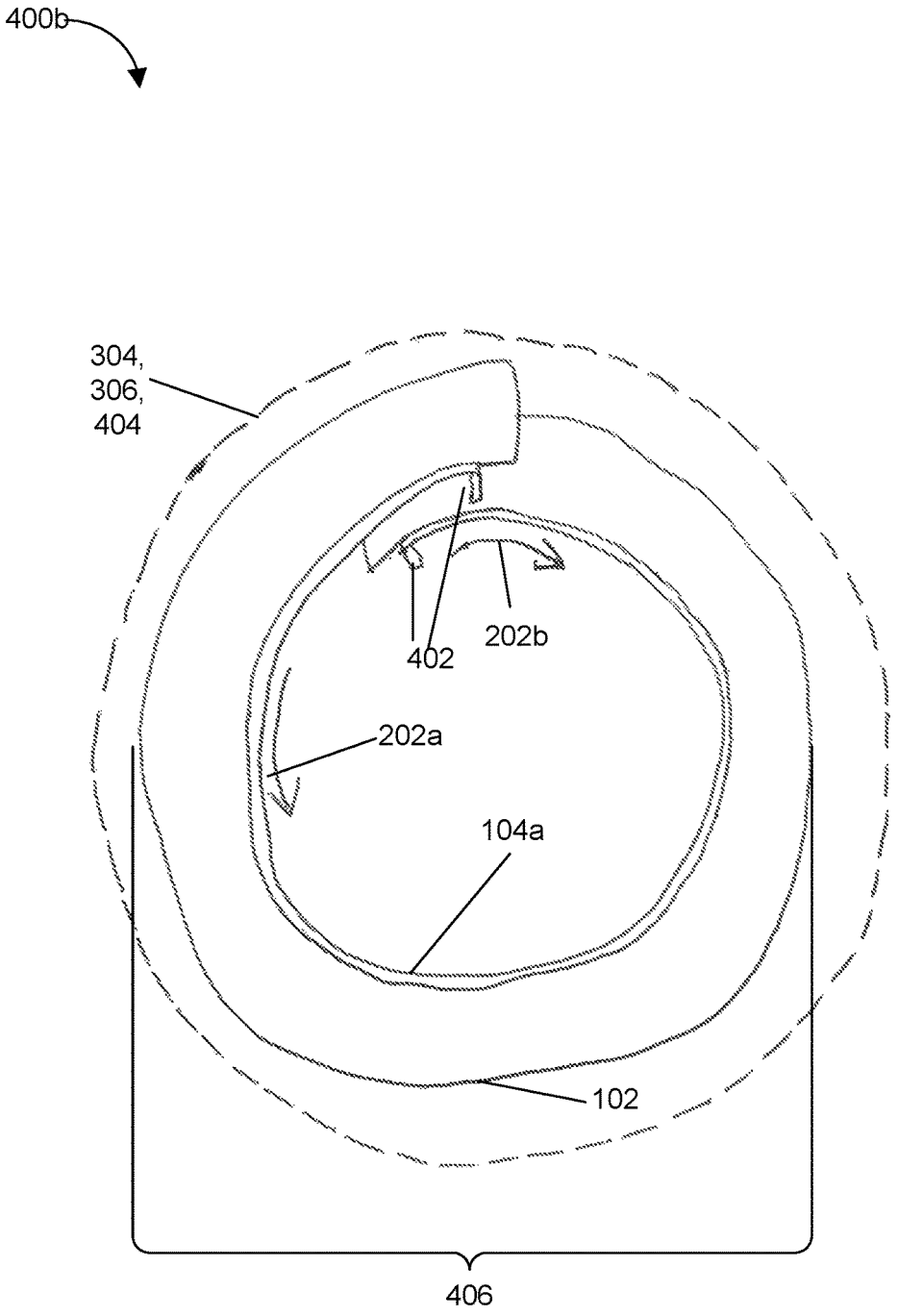
FIG. 4B shows a top view of a compressed, folded or rolled configuration of the protective bib inserted into the container.
Figure 4C:
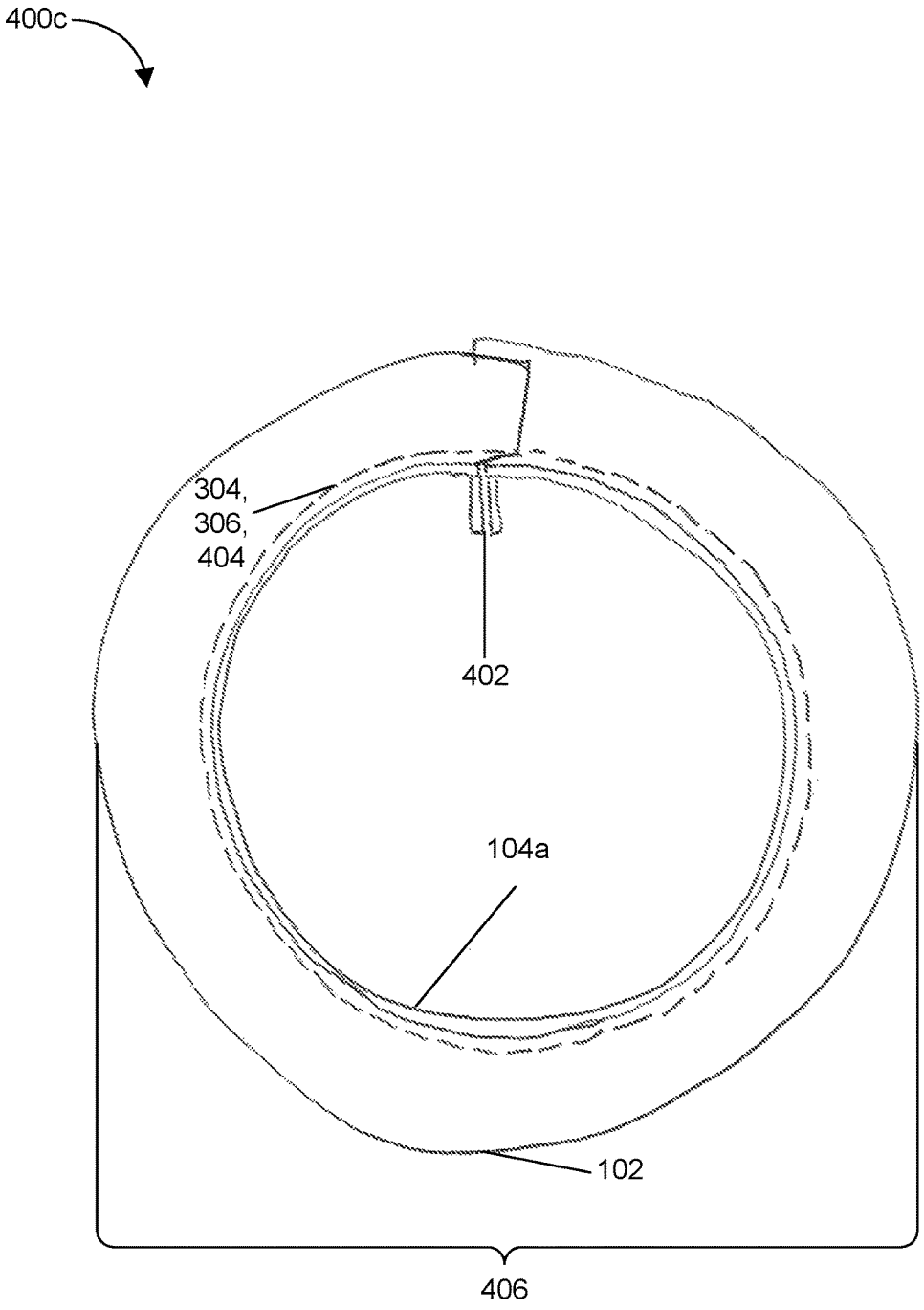
FIG. 4C shows a top view of the protective bib in a partly expanded configuration to fit the container.

First mount 104*a* may be configured to be manually contracted, e.g., as indicated in FIG. 2, and to expand freely when released to apply an expansive force effective to hold first portion 106*a* of flexible barrier layer 102 against inside wall 306*a* of a container 302, e.g., as indicated in FIG. 3A. First mount 104*a* may be configured to overlap a first edge of flexible barrier layer 102 and a second edge of flexible barrier layer 102 to at least temporarily form a continuous conduit portion 406 extending between first and second portions 106*a* and 106*b* of the flexible barrier 102, e.g., as shown in FIGS. 4A-4C and described herein. Second portion 106*b* of flexible barrier layer 102 may be configured to extend across a container edge 308 that may define container opening 304 in container wall 306.

In some embodiments, first mount 104*a* may include a surface that is substantially free of adhesive, e.g., a surface free of contact with flexible barrier layer 102. Flexible barrier layer 102 and first mount 104*a* may be adapted to relax to a flat-pack configuration, for example, to reduce the volume of packaging a set of multiple protective bibs for sale, to reduce shipping, handling, or storage concerns, and the like. Flexible barrier layer 102 may be characterized by extending between first portion 106*a* and second portion 106*b* at a substantially constant width. For example, as shown in FIG. 1A, flexible barrier layer 102 may be in the form of a rectangle. First mount 104*a* may exclude one or more of: a flange (not shown); a retaining member (not shown); and one or more retaining holes (not shown). First mount 104*a* may include a plurality of handling members 402 configured to facilitate manual contraction of first mount 104*a* effective for insertion of first mount 104*a* and first portion 106*a* of flexible barrier layer 102 into the container, e.g., as shown in FIGS. 4A-4C and described herein. Flexible barrier layer 102 may be configured in the form of at least one of: a continuous film, a permeable membrane, a woven fibrous material, a nonwoven fibrous material, a foil, and a combination thereof. Flexible barrier layer 102 may include at least one of: a synthetic polymer, a synthetic fiber, a natural polymer, a natural fiber, a metal foil or coating, and a combination thereof. In some embodiments of the protective bib, the one or more mounts may consist of first mount 104*a*, e.g., as shown in FIGS. 1A-3B. The one or more mounts may include a second mount 104*b* coupled to second portion 106*b* of flexible barrier layer 102. Second mount 104*b* may be configured to hold second portion 106*b* of flexible barrier layer 102 at an outside wall 306*b* of the container 302, e.g., as shown in FIG. 3C.

The protective bib may include instructions printed thereon, e.g., on flexible barrier layer 102. Such instructions may direct a user to use the protective bib with the container according to any description provided herein. The instructions may include indicia (not shown), for example, one or more arrows printed thereon indicating a direction of folding or rolling of first mount 104*a* and flexible barrier layer 102 together, e.g., to make continuous conduit portion 406. The indicia may include, for example, an overlap indicator (not shown) to show how far a user may fold or roll first mount 104*a* and flexible barrier layer 102 together, e.g., to make continuous conduit portion 406. The indicia may include, for example, a depth indicator (not shown) to show how far a user may insert the protective bib into a container.

Referring to FIGS. 1A, 1B, 3A, 3B, and 3C, various embodiments include protective bib 100*a* for a container opening 304 in container 302. Protective bib 100*a* may include a flexible barrier layer 102. Protective bib 100*a* may include a first mount 104*a*. First mount 104*a* may be configured to be coupled to a first portion 106*a* of flexible barrier layer 102 to hold first portion 106*a* of flexible barrier layer 102 at a first side 306*a* of a container wall. In some embodiments, first mount 104*a* may be coupled to first portion 106*a* of flexible barrier layer 102. Flexible barrier layer 102 may be configured to extend across a container edge 308 that may define container opening 304 in container wall 306.

Referring to FIGS. 1A, 1B, in several embodiments, flexible barrier layer 102 may be configured to extend beyond both ends of one or more of first mount 104*a* and second mount 104*b*. Flexible barrier layer 102 may be configured (not shown) to extend beyond one end of one or more of first mount 104*a* and second mount 104*b*. Flexible barrier layer 102 may be configured (not shown) to extend to one or more ends of one or more of first mount 104*a* and second mount 104*b*. Flexible barrier layer 102 may be configured (not shown) to extend just short of one or both ends of one or more of first mount 104*a* and second mount 104*b*.

In some embodiments, flexible barrier layer 102 may be configured to extend across container edge 308 and through container opening 304 such that a second portion 106*b* of flexible barrier layer 102 may extend to a second side 306*b* of container wall 306 opposite first side 306*a* of container wall 306.

In several embodiments, flexible barrier layer 102 may be configured to extend across container edge 308 that may define container opening 304 in container wall 306. Flexible barrier layer 102 may at least partly shield container edge 308 from material (not shown) moving through container opening 304 in container wall 306. Flexible barrier layer 102 may at least partly shield debris (not shown) at container edge 308 from moving through container opening 304 into container 302.

FIGS. 4A, 4B, and 4C depict top views of various steps in inserting protective bib 100*a* into container 302. FIG. 4A shows compression, folding, or rolling operation 400*a* of protective bib 100*a* as in FIG. 2. FIG. 4B shows a compressed, folded or rolled configuration 400*b* of protective bib 100*a* inserted into the container 302. FIG. 4C shows the protective bib 100*a* from FIG. 4B, in an partly expanded configuration 400*c* to fit container 302.

In further embodiments, flexible barrier layer 102 may be configured to extend along at least a portion of a perimeter 404 of container opening 304 in container wall 306. Flexible barrier layer 102 may be configured to extend along an entire portion of perimeter 404 of container opening 304 in container wall 306.

In various embodiments, flexible barrier layer 102 may be configured in the form of at least one of: a continuous film, a permeable membrane, a woven fibrous material, a nonwoven fibrous material, a foil, or a combination or composite thereof. Flexible barrier layer 102 may also include one or more of: a hydrophobic composition, a hydrophilic composition, a vapor permeable liquid barrier, a vapor impermeable liquid barrier, a nonstick composition, an antistatic composition, an electrostatic attracting composition, a tackifying composition, an antifungal composition, an antiviral composition, an antibiotic composition, an anti-parasite composition, an anti-insect composition, a curing agent, a curing inhibitor, or an indicator composition. Flexible barrier layer 102 may alternatively include at least one of: a synthetic polymer, a synthetic fiber, a natural polymer, a natural fiber, a metal foil or coating, or a combination or composite thereof. For example, a woven fibrous material may include a woven fabric, mesh, or netting, such as a woven nylon material commonly associated with pantyhose. A woven fibrous material may be selected to have an interaction with the contents of the container such that the contents of the container do not pass through the woven fibrous material. For example, the container may contain a water-based paint. The woven fibrous material may be made of a relatively hydrophobic fiber, of a fiber diameter and woven sufficiently tightly such that the water-based paint may be excluded from traversing the woven fibrous material.

In some embodiments, flexible barrier layer 102 may be configured in the form of a sheet and first mount 104*a* may be configured to hold flexible barrier layer 102 at first side 306*a* of container wall 306 to overlap a first edge of flexible barrier layer 102 and a second edge of flexible barrier layer 102 to at least temporarily form continuous conduit portion 406 from the flexible barrier. Flexible barrier layer 102 may include a continuous conduit portion 406. Continuous conduit portion 406 may be configured to at least partly conform to at least a portion of perimeter 404 of container opening 304 in container wall 306. Continuous conduit portion 406 may be configured to at least partly conform to at least a portion of perimeter 404 of container opening 304 in container wall 306. Flexible barrier layer 102 may further be configured to form a gasket between container opening 304 and a container lid (not shown) configured to close container opening 304 in container wall 306. Flexible barrier layer 102 may also include one or more portions that may be each independently one or more of transparent, translucent, opaque, colored, or include graphical or written instructions, logos, advertising, or the like.

In several embodiments, first mount 104*a* may be configured to hold flexible barrier layer 102 at first side 306*a* of container wall 306 along at least a portion of perimeter 404 of container opening 304 in container wall 306. First mount 104*a* may be configured to hold flexible barrier layer 102 at first side 306*a* of container wall 306 along an entire portion of perimeter 404 of container opening 304 in container wall 306.

In further embodiments, first mount 104*a* may be configured to apply a force to hold flexible barrier layer 102 at first side 306*a* of container wall 306 by may include at least one of: an elastic material; a hydrogel; a magnetic material; an adhesive material, a mechanical fastener, or a combination or composite thereof.

In various embodiments, first mount 104*a* may include at least one of: a synthetic polymer, a synthetic fiber, a natural polymer, a natural fiber, a ceramic, a metal, or a combination or composite thereof. First mount 104*a* may be configured to apply an expansive force to hold flexible barrier layer 102 at first side 306*a* of container wall 306, first side 306*a* of container wall 306 may be inside container 302. First mount 104*a* may be configured to permanently hold first portion 106*a* of flexible barrier layer 102 at first side 306*a* of container wall 306.

In some embodiments, flexible barrier layer 102 may include an open end at first portion 106*a* of flexible barrier layer 102 and extending therefrom to a closed end of flexible barrier layer 102 such that flexible barrier layer 102 may be configured to substantially surround an outside of container 302. First mount 104*a* may be configured to apply a contractile force to hold flexible barrier layer 102 at first side 306*a* of container wall 306 when first side 306*a* of container wall 306 may be outside container 302. Flexible barrier layer 102 may include an open end at first portion 106*a* of flexible barrier layer 102 and extending therefrom to a closed end of flexible barrier layer 102 such that flexible barrier layer 102 may be configured to extend the closed end into container 302. Flexible barrier layer 102 may be configured to hold a solid or liquid inside container 302.

In several embodiments, first mount 104*a* may include one or more of: a hydrophobic composition, a hydrophilic composition, a vapor permeable liquid barrier, a vapor impermeable liquid barrier, a nonstick composition, an antistatic composition, an electrostatic attracting composition, a tackifying composition, an antifungal composition, an antiviral composition, an antibiotic composition, an anti-parasite composition, an anti-insect composition, a curing agent, a curing inhibitor, or an indicator composition.

In further embodiments, protective bib 100*a* may further include a second mount 104*b* coupled to a second portion 106*b* of flexible barrier layer 102. Second mount 104*b* may hold second portion 106*b* of flexible barrier layer 102 at a second side 306*b* of container wall 306 such that flexible barrier layer 102 may extend across container edge 308 that may define container opening 304 in container wall 306.

In various embodiments, one or both of first mount 104*a* and second mount 104*b* may be in the form of a continuous hoop or loop. For example, first mount 104*a* may include an elastic hoop configured to exert an expansive force against side 306*a* as an inside wall of container wall 306. Alternatively, first mount 104*a* may include an elastic loop configured to exert a compressive force against side 306*a* as an outside wall of container wall 306. Second mount 104*b* may include an elastic hoop configured to exert an expansive force against side 306*b* as an inside wall of container wall 306. One or both of first mount 104*a* and second mount 104*b* may be provided separately from flexible barrier layer 102, for example, as separate components included in the kit described herein. In such embodiments, the kit may include instructions directing a user to combine one or both of first mount 104*a* and second mount 104*b* together with flexible barrier layer 102 to form and/or apply protective bib 100*a* to container opening 304 in container 302.

In various embodiments of protective bib 100*a*, first side 306*a* of container wall 306 and first portion 106*a* of flexible barrier layer 102 may be inside container 302. Second side 306*b* of container wall 306 and second portion 106*b* of flexible barrier layer 102 may be outside container 302.

In some embodiments of protective bib 100*a*, first mount 104*a* may be configured to expand against an inside wall of container 302. Second mount 104*b* may be configured to contract against an outside wall of container 302.

In several embodiments, protective bib 100*a* may further include one or more handling members 402 coupled to first mount 104*a*. One or more handling members 402 may be configured for manually applying first mount 104*a* to hold first portion 106*a* of flexible barrier layer 102 at first side 306*a* of container wall 306. One or more handling members 402 may include a plurality of finger grips. One or more handling members 402 may be configured to manually contract first mount 104*a* to a contracted position. One or more handling members 402 may be configured to permit first mount 104*a* to expand from the contracted position to first side 306*a* of container wall 306, wherein first side 306*a* of container wall 306 may be inside container 302. One or more handling members 402 may be configured to manually expand first mount 104*a* to an expanded position. One or more handling members 402 may be configured to permit first mount 104*a* to contract from the expanded position to first side 306*a* of container wall 306. First side 306*a* of container wall 306 may be outside container 302.

In further embodiments, protective bib 100*a* may further include a second mount 104*b* coupled to a second portion 106*b* of flexible barrier layer 102. Second mount 104*b* may be configured to hold second portion 106*b* of flexible barrier layer 102 at second side 306*b* of container wall 306 such that flexible barrier layer 102 may extend across container edge 308 that may define container opening 304 in container wall 306. A plurality of handling members 402 may be included. At least one of plurality of handling members 402 may be coupled to each of first mount 104*a* and second mount 104*b*. Plurality of handling members 402 may be configured to independently manually contract first mount 104*a* to a contracted position. Plurality of handling members 402 may be configured to independently permit first mount 104*a* to expand from the contracted position to first side 306*a* of container wall 306 wherein first side 306*a* of container wall 306 may be inside container 302. Plurality of handling members 402 may be configured to independently manually expand second mount 104*b* to an expanded position. Plurality of handling members 402 may be configured to independently permit second mount 104*b* to contract from the expanded position to second side 306*b* of container wall 306 wherein second side 306*b* of container wall 306 may be outside container 302.

In various embodiments, protective bib 100*a* may be configured for sterile or aseptic use. Protective bib 100*a* may be at least partly disposable. Protective bib 100*a* may be at least partly biodegradable and/or photodegradable. Protective bib 100*a* may be at least partly reusable and/or washable. Protective bib 100*a* may be at least partly recyclable. Protective bib 100*a* may be configured for use with container 302 containing paint, stain, adhesive, varnish, shellac, sealant, oil, fuel, chemicals, powder, food, beverages, or medical materials. Protective bib 100*a* may further include container 302. Container 302 may be configured as one or more of a paint can, a compression fit lidded container, a screw lidded container, an expansion fit or cork lidded container, a clasp lidded container, or the like. For example, a common paint can may be configured as a compression fit lidded container, but may also be closed with an expansion fit or cork type lid.

In some embodiments, protective bib 100*a* may further include instructions for using protective bib 100*a* with container 302. The instructions may include applying first mount 104*a* to hold first portion 106*a* of flexible barrier layer 102 at first side 306*a* of container wall 306. The instructions may include extending the flexible barrier layer across container edge 308 that may define container opening 304 in container wall 306. The instructions may include employing flexible barrier layer 102 to at least partly shield container edge 308 from material moving through container opening 304 in container wall 306. The instructions may include employing flexible barrier layer 102 to at least partly shield debris at container edge 308 from moving through container opening 304 into container 302. The instructions may include employing the protective bib 100*a* with container 302 containing paint, stain, adhesive, varnish, shellac, sealant, oil, fuel, chemicals, powder, food, beverages, or medical materials. The instructions may include coupling first mount 104*a* to first portion 106*a* of flexible barrier layer 102 to hold first portion 106*a* of flexible barrier layer 102 at first side 306*a* of container wall 306. The instructions (not shown) may be printed directly on one or more of flexible barrier layer 102 and first mount 104*a*, or the instructions may be provided on a separate label or insert (not shown) provided with protective bib 100*a*.

In further embodiments, protective bib 100*a* is not in the form of a bag having a closed end and an open end.

In various embodiments, a method for protecting a container opening is provided. The method may include providing a container comprising: an inside wall; an outside wall; and a container opening defined by an edge. The method may include providing a protective bib, e.g., protective bib 100*a*. Protective bib 100*a* may include a flexible barrier layer 102, which may be, for example, in the form of a sheet. Flexible barrier layer 102 may have first and second portions 106*a* and 106*b*, respectively. Protective bib 100*a* may include a first mount 104*a*. First mount 104*a* may be coupled to first portion 106*a* of flexible barrier layer 102 by a bond; by at least partial containment within a pocket, provided that flexible barrier layer 102 and first mount 104*a* are not configured to be tied or hooked together; by integral formation with flexible barrier layer 102; and the like. Flexible barrier layer 102 may be configured to extend across a container edge 308 that may define container opening 304 in container wall 306. First mount 104*a* may be configured to be manually contracted, e.g., as indicated in FIG. 2, and to expand freely when released to apply an expansive force effective to hold first portion 106*a* of flexible barrier layer 102 against inside wall 306*a* of a container 302. First mount 104*a* may be configured to overlap a first edge of flexible barrier layer 102 and a second edge of flexible barrier layer 102 to at least temporarily form a continuous conduit portion 406 extending between first and second portions 106*a* and 106*b* of the flexible barrier 102. Second portion 106*b* of flexible barrier layer 102 may be configured to extend across a container edge 308 that may define container opening 304 in container wall 306. The method may include providing first mount 104*a* in a contracted position. The method may include inserting first mount 104*a* in the contracted position through the container opening. The method may include releasing first mount 104*a* to expand from the contracted position to apply an expansive force effective to hold first portion 106*a* of flexible barrier layer 102 against the inside wall of the container. The method may include folding second portion 106*b* of flexible barrier layer 102 across at least a portion of the container edge.

In several embodiments, the method may include at least partly shielding the edge from contents of the container moving through the container opening. The method may include at least partly shielding debris at the edge of the container opening, e.g., rust from the container metal, from moving through the opening to contact the contents of the container. The method may include employing the flexible barrier to form a gasket between the container opening and a container lid configured to close the opening in the container wall. The method may include employing a second mount coupled to the second portion of the flexible barrier layer to contact the second portion of the flexible barrier layer to the outside wall. The method may include providing the flexible barrier layer and the first mount in a flat-pack configuration. The method may include contracting the first mount to the contracted position. The first mount may include a plurality of handling members and the method may include contracting the first mount to the contracted position using the plurality of handling members.

Figure 5:
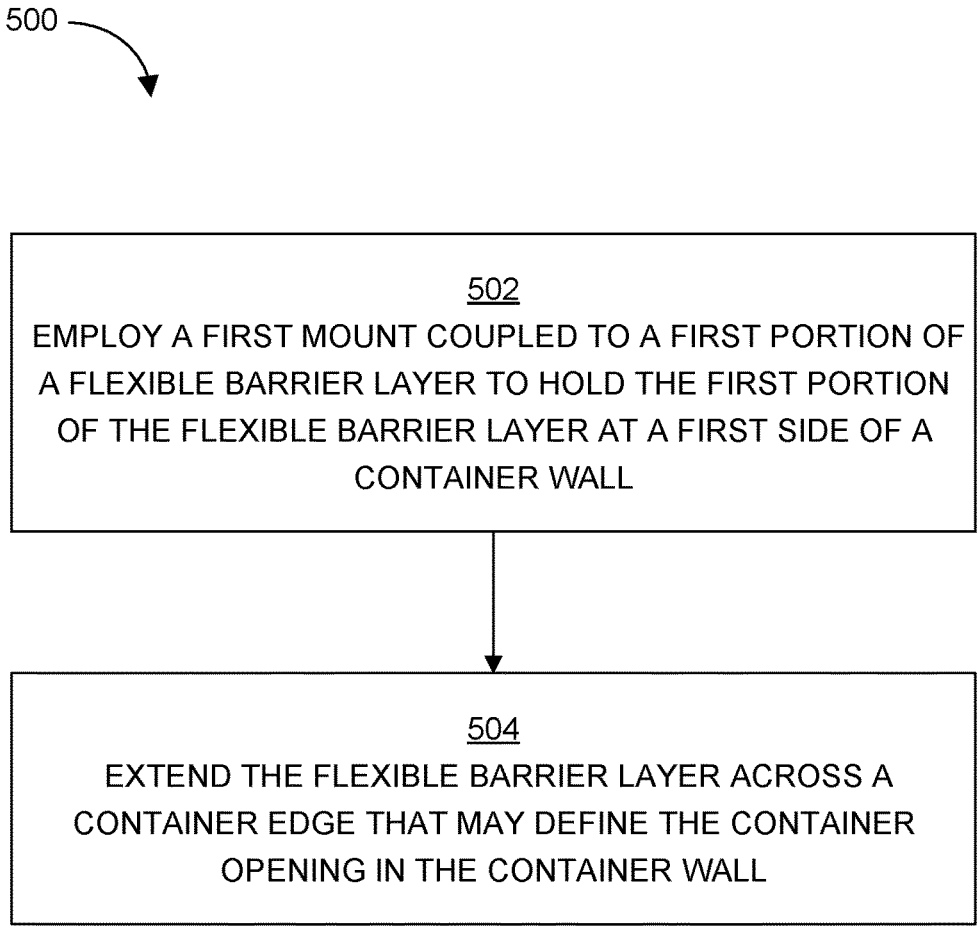
FIG. 5 is a flow diagram of a method for employing the protective bib, all arranged in accordance with at least some embodiments described herein.

FIG. 5 is a flow diagram of a method 500 for employing the protective bib for protecting a container opening. The method may include employing a first mount coupled to a first portion of a flexible barrier layer to hold the first portion of the flexible barrier layer at a first side of a container wall (step 502). The method may also include extending the flexible barrier layer across a container edge that may define the container opening in the container wall (step 504).

In various embodiments, the method may also include extending the flexible barrier layer through the opening such that a second portion of the flexible barrier layer may extend to a second side of the container wall opposite the first side of the container wall. The method may also include moving material through the opening in the container wall such that extending the flexible barrier layer across the container edge may include at least partly shielding the container edge from the material.

In several embodiments, extending the flexible barrier layer across the container edge may include at least partly shielding debris at the container edge from moving through the opening into the container. Extending the flexible barrier layer across the container edge may include extending the flexible barrier layer along at least a portion of a perimeter of the opening in the container wall. Extending the flexible barrier layer across the container edge may include extending along an entire portion of a perimeter of the opening in the container wall.

In further embodiments of the method, the flexible barrier layer may be configured in the form of at least one of: a continuous film, a permeable membrane, a woven fibrous material, a nonwoven fibrous material, a foil, or a combination or composite thereof. The flexible barrier layer may include one or more of: a hydrophobic composition, a hydrophilic composition, a vapor permeable liquid barrier, a vapor impermeable liquid barrier, a nonstick composition, an antistatic composition, an electrostatic attracting composition, a tackifying composition, an antifungal composition, an antiviral composition, an antibiotic composition, an anti-parasite composition, an anti-insect composition, a curing agent, a curing inhibitor, or an indicator composition. The flexible barrier layer may include at least one of: a synthetic polymer, a synthetic fiber, a natural polymer, a natural fiber, a metal foil or coating, or a combination or composite thereof. For example, a woven fibrous material may include a woven fabric, mesh, or netting, such as a woven nylon material commonly associated with pantyhose. A woven fibrous material may be selected to have an interaction with the contents of the container such that the contents of the container do not pass through the woven fibrous material. For example, the container may contain a water-based paint. The woven fibrous material may be made of a relatively hydrophobic fiber, of a fiber diameter and woven sufficiently tightly such that the water-based paint may be excluded from traversing the woven fibrous material.

In various embodiments, the flexible barrier layer may include a continuous conduit portion, wherein extending the flexible barrier layer across the container edge may include least partly conforming the flexible barrier layer to at least a portion of a perimeter of the opening in the container wall. The flexible barrier layer may be configured in the form of a sheet, wherein employing the first mount to hold the first portion of the flexible barrier layer at the first side of the container wall may include overlapping a first edge of the flexible barrier layer and a second edge of the flexible barrier layer to at least temporarily form a conduit from the flexible barrier, the conduit may be configured to at least partly conform to at least a portion of a perimeter of the opening in the container wall.

In some embodiments, extending the flexible barrier layer across the container edge may include forming a gasket between the container opening and a container lid configured to close the opening in the container wall. The flexible barrier layer may include one or more portions that may be each independently one or more of transparent, translucent, opaque, or colored, or include graphical or written instructions, logos, advertising, or the like. For example, instructions may be included as described herein for using the protective bib.

In several embodiments, employing the first mount to hold the first portion of the flexible barrier layer at the first side of the container wall may include holding the flexible barrier layer at the first side of the container wall along at least a portion of a perimeter of the opening in the container wall. Employing the first mount to hold the first portion of the flexible barrier layer at the first side of the container wall may include holding the flexible barrier layer at the first side of the container wall along an entire portion of a perimeter of the opening in the container wall. Employing the first mount to hold the first portion of the flexible barrier layer at the first side of the container wall may include applying a force to hold the flexible barrier layer at the first side of the container wall by using at least one of: an elastic material; a hydrogel; a magnetic material; an adhesive material, a mechanical fastener, or a combination or composite thereof.

In further embodiments of the method, the first mount may include at least one of: a synthetic polymer, a synthetic fiber, a natural polymer, a natural fiber, a ceramic, a metal, or a combination or composite thereof. Employing the first mount to hold the first portion of the flexible barrier layer at the first side of the container wall may include applying an expansive force to hold the flexible barrier layer at the first side of the container wall, the first side of the container wall may be inside the container.

In various embodiments, extending the flexible barrier layer across the container edge may include extending the flexible barrier layer from an open end at the first portion of the flexible barrier layer to a closed end such that the flexible barrier layer substantially surrounds an outside of the container. Employing the first mount to hold the first portion of the flexible barrier layer at the first side of the container wall may include applying a contractile force to hold the flexible barrier layer at the first side of the container wall when the first side of the container wall may be outside the container. The flexible barrier layer may extend from an open end at the first portion of the flexible barrier layer to a closed end and the method may include extending the closed end into the container. The flexible barrier layer may be configured to hold a solid or liquid inside the container.

In some embodiments of the method, the first mount may include one or more of: a hydrophobic composition, a hydrophilic composition, a vapor permeable liquid barrier, a vapor impermeable liquid barrier, a nonstick composition, an antistatic composition, an electrostatic attracting composition, a tackifying composition, an antifungal composition, an antiviral composition, an antibiotic composition, an anti-parasite composition, an anti-insect composition, a curing agent, a curing inhibitor, or an indicator composition.

In various embodiments, the method may also include employing a second mount coupled to a second portion of the flexible barrier layer to hold the second portion of the flexible barrier layer at a second side of the container wall such that the flexible barrier layer may extend across the container edge that may define the opening in the container wall. The first side of the container wall and the first portion of the flexible barrier layer may be inside the container. The second side of the container wall and the second portion of the flexible barrier layer may be outside the container. The first mount may be configured to expand against an inside wall of the container. The second mount may be configured to contract against an outside wall of the container.

In several embodiments, the method may also include manually applying the first mount to hold the first portion of the flexible barrier layer at the first side of the container wall by using one or more handling members coupled to the first mount. The one or more handling members may include a plurality of finger grips. Manually applying the first mount may include manually contracting the first mount to a contracted position and expanding the first mount from the contracted position to the first side of the container wall wherein the first side of the container wall may be inside the container. Manually applying the first mount may include manually expanding the first mount to an expanded position and contracting the first mount from the expanded position to the first side of the container wall wherein the first side of the container wall may be outside the container.

In further embodiments, the method may also include employing a second mount coupled to a second portion of the flexible barrier layer to hold the second portion of the flexible barrier layer at a second side of the container wall such that the flexible barrier layer may extend across the container edge that may define the opening in the container wall. The method may also include employing a plurality of handling members. At least one of the plurality of handling members may be coupled to each of the first mount and the second mount. At least one of the plurality of handling members may independently manually contract the first mount to a contracted position and expand the first mount from the contracted position to the first side of the container wall wherein the first side of the container wall may be inside the container. Alternatively, at least one of the plurality of handling members may independently manually expand the second mount to an expanded position and contract the second mount from the expanded position to the second side of the container wall wherein the second side of the container wall may be outside the container.

In various embodiments, the method may also include sterilizing the protective bib. The method may also include maintaining aseptic conditions using the protective bib. The method may also include disposing the protective bib. The method may also include at least partly biodegrading and/or photo-degrading the protective bib. The method may also include at least partly reusing and/or washing the protective bib. The method may also include at least partly recycling the protective bib. The method may also include using the protective bib with the container containing any of the materials described herein. The container may be configured as a paint can, a compression fit lidded container, a screw lidded container, an expansion fit or cork lidded container, a clasp lidded container, or the like. The container may be configured to hold materials including the form of, but not limited to, solids, liquids, suspensions, slurries, powders, particulates, textiles, mechanical parts, and the like. The container may be configured to contain materials including, but not limited to, coatings (such as paint, stain, adhesive, varnish, shellac, sealant), oil, fuels, food or beverage, medicines or other medical supplies, cleaning agents, construction materials, waste materials, scientific supplies including chemicals, general household materials, and the like.

In some embodiments of the method, the protective bib is not in the form of a bag having a closed end and an open end.

In various embodiments, the method may include using an applicator (not shown) to insert the protective bib into the container opening of the container. For example, the applicator may be configured in the form of a tube or portion thereof, or funnel or portion thereof. The applicator may have an exit. The exit of the applicator may be configured to be smaller in diameter compared to the container opening. The method may include using the applicator to form the protective bib into a configuration suitable for insertion into the container opening of the container. For example, the method may include using the applicator to compress the protective bib smaller than a diameter of the container opening of the container. The applicator may further include a plurality of the protective bibs. The method may include using the applicator to insert the protective bib into the container opening of the container where the applicator may be configured to hold a plurality of the protective bibs. For example, the method may include using the applicator to repeatedly or sequentially dispense individual protective bibs from the plurality of the protective bibs each into one of a plurality of the container openings of a plurality of the containers.

In various embodiments a kit is provided. The kit may include a protective bib, e.g., protective bib 100*a*. Protective bib 100*a* may include a flexible barrier layer 102, which may be, for example, in the form of a sheet. Flexible barrier layer 102 may have first and second portions 106*a* and 106*b*, respectively. Protective bib 100*a* may include a first mount 104*a*. First mount 104*a* may be coupled to first portion 106*a* of flexible barrier layer 102 by a bond; by at least partial containment within a pocket, provided that flexible barrier layer 102 and first mount 104*a* are not configured to be tied or hooked together; by integral formation with flexible barrier layer 102; and the like. Flexible barrier layer 102 may be configured to extend across a container edge 308 that may define container opening 304 in container wall 306. First mount 104*a* may be configured to be manually contracted, e.g., as indicated in FIG. 2, and to expand freely when released to apply an expansive force effective to hold first portion 106*a* of flexible barrier layer 102 against inside wall 306*a* of a container 302. First mount 104*a* may be configured to overlap a first edge of flexible barrier layer 102 and a second edge of flexible barrier layer 102 to at least temporarily form a continuous conduit portion 406 extending between first and second portions 106*a* and 106*b* of the flexible barrier 102. Second portion 106*b* of flexible barrier layer 102 may be configured to extend across a container edge 308 that may define container opening 304 in container wall 306. The kit may include instructions for using the protective bib with the container. The instructions may include providing first mount 104*a* in a contracted position. The instructions may include inserting first mount 104*a* in the contracted position through the container opening. The instructions may include releasing first mount 104*a* to expand from the contracted position to apply an expansive force effective to hold first portion 106*a* of flexible barrier layer 102 against the inside wall of the container. The instructions may include folding second portion 106*b* of flexible barrier layer 102 across at least a portion of the edge.

In various embodiments, the instructions may direct a user to use the protective bib with the container according to any description provided herein. For example, the instructions may direct the user to employ the container as one or more of a paint can, a compression fit lidded container, a screw lidded container, an expansion fit or cork lidded container, or a clasp lidded container. The instructions may include at least partly shielding the edge from contents of the container moving through the container opening. The instructions may include at least partly shielding debris at the edge of the container opening from moving through the opening to contact the contents of the container. The instructions may include indicia (not shown), for example, one or more arrows printed thereon indicating a direction of folding or rolling of first mount 104*a* and flexible barrier layer 102 together, e.g., to make continuous conduit portion 406. The indicia may include, for example, an overlap indicator (not shown) to show how far a user may fold or roll first mount 104*a* and flexible barrier layer 102 together, e.g., to make continuous conduit portion 406. The indicia may include, for example, a depth indicator (not shown) to show how far a user may insert the protective bib into a container. the instructions may instructions directing In the kit, the protective bib 100*a* may include a second mount 104*b* coupled to second portion 106*b* of flexible barrier layer 102. The instructions may include holding the second portion of the flexible barrier layer at the outside wall of the container wall such that the flexible barrier layer 102 extends across the edge.

Several embodiments include a kit. The kit may include protective bib 100*a* for container opening 304 in container 302. Protective bib 100*a* may include a flexible barrier layer and first mount 104*a*. First mount 104*a* may be coupled to a first portion of the flexible barrier layer to hold the first portion of the flexible barrier layer at a first side of a container wall 306. The flexible barrier layer may be configured to extend across container edge 308 that may define container opening 304 in container wall 306. The kit may also include instructions for using protective bib 100*a* with container 302. The instructions may include applying first mount 104*a* to hold the first portion of the flexible barrier layer at first side 306*a* of container wall 306. The instructions may also include extending the flexible barrier layer across container edge 308 that may define container opening 304 in container wall 306.

In various embodiments of the kit, one or both of first mount 104*a* and a second mount 104*b* may be in the form of a continuous hoop or loop. For example, first mount 104*a* may include an elastic hoop configured to exert an expansive force against side 306*a* as an inside wall of container wall 306. Alternatively, first mount 104*a* may include an elastic loop configured to exert a compressive force against side 306*a* as an outside wall of container wall 306. Second mount 104*b* may include an elastic hoop configured to exert an expansive force against side 306*b* as an inside wall of container wall 306.

In several embodiments of the kit, one or both of first mount 104*a* and second mount 104*b* may be provided separately from flexible barrier layer 102, for example, as separate components included in the kit. In such embodiments, the kit may include instructions directing a user to combine one or both of first mount 104*a* and second mount 104*b* together with flexible barrier layer 102 to form and/or apply protective bib 100*a* to container opening 304 in container 302.

Various embodiments of the kit may include a container. Container 302 may include a container wall 306. Container wall 306 may have an inside that may define a chamber. Container wall 306 may also have an outside. Container 302 may also include container edge 308 that may define container opening 304 in container wall 306. Container 302 may also include protective bib 100*a*. Protective bib 100*a* may include a flexible barrier layer and a first mount. First mount 104*a* may be coupled to a first portion of the flexible barrier layer to hold the first portion of the flexible barrier layer at a first side of container wall 306. The flexible barrier layer may be configured to extend across container edge 308 that may define container opening 304 in container wall 306.

In several embodiments of the kit, container 302 may be configured as a paint can, a paint can, a compression fit lidded container, a screw lidded container, an expansion fit or cork lidded container, a clasp lidded container, or the like.

In some embodiments of the kit, the kit may include an applicator (not shown). For example, the applicator may be configured in the form of a tube or portion thereof, or funnel or portion thereof. The applicator may have an exit. The exit of the applicator may be configured to be smaller in diameter compared to the container opening 304. The applicator may be configured to form the protective bib 100*a* for insertion into the container opening 304 of the container 302. The applicator may function, for example, by forming the protective bib 100*a* into a configuration suitable for insertion into the container opening 304, for example, by compressing the protective bib 100*a* to a diameter smaller than the container opening 304. The applicator may also function, for example, by holding the protective bib 100*a* in the configuration suitable for insertion into the container opening 304. The applicator may also function, for example, by dispensing the protective bib 100*a* in the configuration from the applicator into the container opening 304. The instructions of the kit may include using the applicator for forming the protective bib 100*a* for insertion into the container opening 304 of the container 302. The instructions of the kit may include using the applicator for inserting the protective bib 100*a* into the container opening 304 of the container 302. The instructions of the kit may include using the applicator to perform or facilitate any method or instruction described herein. The applicator may further include a plurality of the protective bibs 100*a*. The instructions of the kit may include using the applicator to insert one of the plurality of the protective bibs 100*a* into the container opening 304 of the container 302. For example, the instructions of the kit may include using the applicator to repeatedly or sequentially dispense individual protective bibs 100*a* from the plurality of the protective bibs 100*a* each into one of a plurality of the container openings 304 of a plurality of the containers 302.

In various embodiments of the kit, protective bib 100*a* may include any feature or combination of features described for protective bib 100*a* herein. The instructions may include any instructions described for protective bib 100*a* herein. For example, the instructions may direct a user to perform any method or combination of methods as described herein.

Various embodiments of the kit may include a container. Container 302 may include a container wall 306. Container wall 306 may have an inside that may define a chamber. Container wall 306 may also have an outside. Container 302 may also include container edge 308 that may define container opening 304 in container wall 306. Container 302 may also include protective bib 100*a*. Protective bib 100*a* may include a flexible barrier layer and a first mount. First mount 104*a* may be coupled to a first portion of the flexible barrier layer to hold the first portion of the flexible barrier layer at a first side of container wall 306. The flexible barrier layer may be configured to extend across container edge 308 that may define container opening 304 in container wall 306.

In several embodiments, container 302 may include a container lid (not shown) configured to close the container opening 304 in container wall 306. Container 302 may be configured as a paint can, a compression fit lidded container, a screw lidded container, an expansion fit or cork lidded container, a clasp lidded container, or the like.

In various embodiments of container 302, protective bib 100*a* may include any feature or combination of features described for protective bib 100*a* herein.

In several embodiments of container 302, instructions may be included for using protective bib 100*a* with container 302, for example any instructions described for protective bib 100*a* herein. Further, for example, the instructions may include instructions to perform any method or combination of methods as described herein.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. To the extent that the term "substantially" is used in the specification or the claims, it is intended to mean that the identified components have the relation or qualities indicated with degree of error as would be acceptable in the subject industry.

As used in the specification and the claims, the singular forms "a," "an," and "the" include the plural unless the singular is expressly specified. For example, reference to "a compound" may include a mixture of two or more compounds, as well as a single compound.

As used herein, the term "about" in conjunction with a number is intended to include ±10% of the number. In other words, "about 10" may mean from 9 to 11.

As used herein, the terms "optional" and "optionally" mean that the subsequently described circumstance may or may not occur, so that the description includes instances where the circumstance occurs and instances where it does not.

In addition, where features or aspects of the disclosure are described in terms of Markush groups, those skilled in the art will recognize that the disclosure is also thereby described in terms of any individual member or subgroup of members of the Markush group. As will be understood by one skilled in the art, for any and all purposes, such as in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, and the like. As a non-limiting example, each range discussed herein can be readily broken down into a lower third, middle third and upper third, and the like. As will also be understood by one skilled in the art all language such as "up to," "at least," "greater than," "less than," include the number recited and refer to ranges which can be subsequently broken down into sub-ranges as discussed above. Finally, as will be understood by one skilled in the art, a range includes each individual member. For example, a group having 1-3 cells refers to groups having 1, 2, or 3 cells. Similarly, a group having 1-5 cells refers to groups having 1, 2, 3, 4, or 5 cells, and so forth. While various aspects and embodiments have been disclosed herein, other aspects and embodiments will be apparent to those skilled in the art.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

The various aspects and embodiments disclosed herein are for purposes of illustration and are not intended to be limiting, with the true scope and spirit being indicated by the following claims.

What is claimed is:

1. A protective bib for a container opening, comprising:

a flexible barrier layer in the form of a sheet comprising first and second portions;

a first mount, the first mount coupled to the first portion of the flexible barrier layer by at least one of:

a bond to the flexible barrier layer;

at least partial containment within a pocket formed of the first portion of the flexible barrier layer, provided that the flexible barrier layer and the first mount are not configured to be tied or hooked together; or integral formation with the flexible barrier layer;

the first mount configured to:

be substantially straight and substantially flat when in an uncontracted position, be manually contracted and to expand freely when released to apply an expansive force effective to hold the first portion of the flexible barrier layer against an inside wall of a container; and a first end of the first mount overlaps another end of the first mount to at least temporarily form a continuous conduit portion extending between the first and second portions of the flexible barrier, the second portion of the flexible barrier layer being configured to extend across an edge of the container opening to an outside wall of the container; and a second mount coupled to the second portion of the flexible barrier layer, the second mount being configured to hold the second portion of the flexible barrier layer at an outside wall of the container.

2. The protective bib of claim 1, the first mount comprising a surface that is substantially free of adhesive.

3. The protective bib of claim 1, the flexible barrier layer and the first mount adapted to relax a flat-pack configuration.

4. The protective bib of claim 1, the flexible barrier layer characterized by extending between the first portion and the second portion at a substantially constant width.

5. The protective bib of claim 1, the first mount excluding one or more of: a flange; a retaining member; and one or more retaining holes.

6. The protective bib of claim 1, the first mount comprising a plurality of handling members configured to facilitate manual contraction of the first mount effective for insertion of the first mount and the first portion of the flexible barrier layer into the container.

7. The protective bib of claim 1, the flexible barrier layer being one or more of:

configured in the form of at least one of: a continuous film, a permeable membrane, a woven fibrous material; a nonwoven fibrous material, a foil, and a combination thereof; and comprising at least one of: a synthetic polymer, a synthetic fiber, a natural polymer, a natural fiber, a metal foil or coating, and a combination thereof.

8. The protective bib of claim 1, further comprising instructions printed thereon directing a user to use the protective bib with the container.

9. A kit, comprising:

a protective bib, comprising:

a flexible barrier layer in the form of a sheet comprising first and second portions; and a first mount coupled to the first portion of the flexible barrier layer by at least one of:

a bond to the flexible barrier layer;

at least partial containment within a pocket formed of the first portion of the flexible barrier layer, provided that the flexible barrier layer and the first mount are not configured to be tied or hooked together; or integral formation with the flexible barrier layer;

the first mount configured to:

be manually contracted and to expand freely when released to apply an expansive force effective to hold the first portion of the flexible barrier layer against the inside wall of the container; and a first end of the first mount overlaps another end of the first mount to at least temporarily form a continuous conduit portion extending between the first and second portions of the flexible barrier, the second portion of the flexible barrier layer being configured to extend across the edge of the container opening to the outside wall, and wherein the second portion of the flexible barrier extends between the first portion and the second portion at a substantially constant width for a length of the flexible barrier layer;

a second mount coupled to the second portion of the flexible barrier layer, the instructions further directing the user to hold the second portion of the flexible barrier layer at the outside wall of the container wall such that the flexible barrier layer extends across the edge; and instructions for using the protective bib with the container, the instructions comprising one or more of:

providing the first mount in a contracted position;

inserting the first mount in the contracted position through the container opening;

releasing the first mount to expand from the contracted position to apply an expansive force effective to hold the first portion of the flexible barrier layer against the inside wall of the container; and folding the second portion of the flexible barrier layer across at least a portion of the edge.

10. The kit of claim 9, the instructions directing the user to employ the container as one or more of a paint can, a compression fit lidded container, a screw lidded container, an expansion fit or cork lidded container, or a clasp lidded container.

11. The kit of claim 9, the instructions further comprising one or more of:

at least partly shielding the edge from contents of the container moving through the container opening; and at least partly shielding debris at the edge of the container opening from moving through the opening to contact the contents of the container.

* * * * *